US009776226B2

(12) United States Patent
Karner et al.

(10) Patent No.: US 9,776,226 B2
(45) Date of Patent: Oct. 3, 2017

(54) TENSION AND GUIDANCE DEVICE, AND METHOD OF ROLLING STRIP MATERIAL

(75) Inventors: Günter Karner, Saeusenstein (AT); Konrad Krimpelstätter, Katsdorf (AT)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 157 days.

(21) Appl. No.: 14/236,774

(22) PCT Filed: Jul. 26, 2012

(86) PCT No.: PCT/EP2012/064648

§ 371 (c)(1),
(2), (4) Date: Feb. 3, 2014

(87) PCT Pub. No.: WO2013/020814

PCT Pub. Date: Feb. 14, 2013

(65) Prior Publication Data

US 2014/0174141 A1 Jun. 26, 2014

(30) Foreign Application Priority Data

Aug. 8, 2011 (EP) ..... 11176837

(51) Int. Cl.
*B21B 1/28* (2006.01)
*B21B 37/48* (2006.01)
(Continued)

(52) U.S. Cl.
CPC ..... *B21B 1/28* (2013.01); *B21B 37/50* (2013.01); *B21B 38/00* (2013.01); *B21B 39/008* (2013.01);
(Continued)

(58) Field of Classification Search
CPC . B21B 2001/221; B21B 39/006; B21B 39/10; B21B 41/08; B21B 41/10;
(Continued)

(56) References Cited

U.S. PATENT DOCUMENTS 4,179,913 A * 12/1979 Martt ..... B21B 15/0085 226/21
4,730,781 A * 3/1988 Richter ..... B21B 39/006 242/559.3
(Continued)

FOREIGN PATENT DOCUMENTS

CN 1527750 9/2004
CN 2700015 5/2005
(Continued)

OTHER PUBLICATIONS

See attached ESCAPENET machine translation of FR2628987A1.*
(Continued)

*Primary Examiner* — Peter DungBa Vo
*Assistant Examiner* — John S Lowe
(74) *Attorney, Agent, or Firm* — Ostrolenk Faber LLP

(57) ABSTRACT

A rolling system, particularly a cold-rolling system for cold-rolling a metal strip (2): having at least one cold-rolling stand (1) an unwinding device (3) upstream of the cold-rolling stand (1), a unit (10) connected between the unwinding device (3) and the cold-rolling stand (1), including at least three rolls (6, 7, 8) each rotationally driven about a rotational axis (6A, 7A, 8A). Each roll (6, 7, 8) can be adjusted individually or together in the direction of the respective rotational axis (6A, 7A, 8A) and in a direction transverse to the rotational axis (6A, 7A, 8A) by a driving and adjusting device (11).

24 Claims, 4 Drawing Sheets

(51) Int. Cl.

| | |
|---|---|
| ***B21B 37/68*** | (2006.01) |
| ***B21B 37/50*** | (2006.01) |
| ***B21B 38/00*** | (2006.01) |
| ***B21B 39/00*** | (2006.01) |
| ***B21B 39/08*** | (2006.01) |

(52) U.S. Cl.
CPC ..... *B21B 39/084* (2013.01); *B21B 37/48* (2013.01); *B21B 37/68* (2013.01)

(58) Field of Classification Search
CPC B21B 39/02; B21B 39/14; B21B 1/40; B21B 39/08; B21B 39/16; B21B 2015/0064; B21B 2015/0071; B21C 47/34; B21C 47/3433; B21C 47/3475; B65H 19/12; B65H 20/10; B65H 2301/522; B65H 2406/11; B65H 2406/30
See application file for complete search history.

(56) References Cited

U.S. PATENT DOCUMENTS

| | | | | |
|---|---|---|---|---|
| 4,898,013 | A * | 2/1990 | Mazodier | B21D 1/05 72/165 |
| 7,185,523 | B2 * | 3/2007 | Hauger | B21B 37/24 72/161 |
| 8,230,711 | B2 * | 7/2012 | Klapdor | B21B 1/34 242/592 |
| 2004/0177666 | A1 * | 9/2004 | Brockes | B21B 37/24 72/205 |
| 2007/0261456 | A1 | 11/2007 | Jepsen | 72/227 |
| 2008/0098786 | A1 * | 5/2008 | Yoshioka | B21B 39/02 72/250 |

FOREIGN PATENT DOCUMENTS

| | | | | |
|---|---|---|---|---|
| CN | 101010154 | | 8/2007 | |
| EP | 1 518 615 | A2 | 3/2005 | |
| EP | 1 784 266 | B1 | 10/2008 | |
| FR | 2 306 023 | A1 | 10/1976 | |
| FR | 2628987 | | 9/1989 | |
| FR | 2628987 | A1 * | 9/1989 | B21B 37/48 |
| GB | 1 512 227 | | 5/1978 | |
| GB | 1512227 | A * | 5/1978 | B21B 15/0007 |
| GE | GB 1512227 | A * | 5/1978 | B21B 15/0007 |
| RU | 2006 135 625 | | 4/2008 | |
| RU | 2008 120 743 | | 11/2009 | |
| SU | 1340862 | | 9/1987 | |

OTHER PUBLICATIONS

Machine translation of FR2628987 from ESCAPENT is attached.*
Original and Machine translations of FR2628987A1 is attached. GB1512227A is in English.*
International Search Report dated Jan. 14, 2013 issued in corresponding International patent application No. PCT/EP2012/064648.
Written Opinion dated Jan. 14 2013 issued in corresponding International patent application No. PCT/EP2012/064648.

* cited by examiner

TENSION AND GUIDANCE DEVICE, AND METHOD OF ROLLING STRIP MATERIAL

CROSS-REFERENCE TO RELATED APPLICATIONS

The present application is a 35 U.S.C. §§371 national phase conversion of PCT/EP2012/064648, filed Jul. 26, 2012, which claims priority of European Patent Application No. 11176837.0, filed Aug. 8, 2011, the contents of which are incorporated by reference herein. The PCT International Application was published in the German language.

TECHNICAL FIELD

The present invention relates to a rolling mill, in particular a cold-rolling mill for the cold-rolling of a metal strip, the rolling mill having at least one cold-rolling stand, with a decoiler located before the cold-rolling stand, where there is a unit in-line between the decoiler and the cold-rolling stand. The present invention relates also to a method for rolling.

PRIOR ART

In the case of mills for rolling a metal strip, it may be necessary to pre-treat the metal strip before the actual rolling process. For example, it may be necessary before a cold-rolling process to anneal the metal strip so that it recrystallizes, in order to return the grain structure to its original unhardened state, so that the material is once again ductile and can be further re-formed. This "recrystallization annealing" is in many cases carried out nowadays in a so-called bell-type annealing furnace under a protective gas atmosphere, e.g. hydrogen. The process of heating up and cooling down takes on average about 48 hours. In order to prevent layers of the sheet which are lying against each other from sticking together when they are red hot, the reel is coiled up under a low forward tension before it passes into the bell-type annealing furnace. After treatment in the bell-type annealing furnace, the metal strip is fed to the cold-rolling stand. For this purpose it must be uncoiled from the reel. However, since the metal strip was coiled using little forward tension, it must now be decoiled also with little forward tension. When this is done, the forward tension can drop greatly. This can lead to jerky fluctuations in the forward tension.

On the other hand, a certain minimum amount of forward tension at the infeed into the cold-rolling stand is desired because this permits a reduction in the force required for rolling.

In order to decouple the decoiling from the actual rolling process an S-roller unit has been proposed, for example in EP 1 784 266 B1. One disadvantage of this is that, especially in the case of hard and/or thick metal strips, it is difficult even with large wrap-arounds on the two S-rollers to realize the desired minimum amount of forward tension at the infeed to a cold-rolling stand. On the other hand, initially feeding the metal strip into the S-roller unit is time-consuming, due to the stiffness of the metal strip. This is especially disadvantageous in the particular case of discontinuous cold-rolling trains, because in the case of these systems the time-consuming initial feed-in must be carried again out for each roll.

A possible situation is that a metal strip must be split along its length in order to be able to process it further on a roll stand with a smaller rolling width. The cross-section of such a lengthwise split rolling strip is then often not symmetrical. The strip is thicker on one side than on the other. In operation, such asymmetrical rolling strips run out of the center of the rolling mill. In order to guarantee that even in the case of an asymmetrical cross-sectional profile the rolling strip runs into the cold-rolling stand centrally, a correction is required to the path of the strip (strip guidance). Only if an exact infeed position can be maintained for the rolling strip is it possible to adhere to the close tolerances prescribed for a cold-rolling process.

Until now, there has been no satisfactory way of achieving the desired tension decoupling—low decoiling tension, highest possible tension at the infeed region of the roll stand—together with the maintenance of an exact infeed position into the first cold-rolling stand.

SUMMARY OF THE INVENTION

It is an objective of the present invention to specify a rolling mill, in particular a cold-rolling mill or a method for cold rolling, as appropriate, such that even for hard and/or thick metal strips it is possible to set, at the infeed region of a cold-rolling stand, a tensional force which is sufficiently high and as far as possible free from fluctuations, and such that correction of the path of the strip and initial feeding-in of the rolling strip is as simple as possible.

This objective is achieved by a rolling mill and by a method in accordance with the invention.

In the case of the inventive rolling mill, use is made between the decoiler and the first roll stand of a unit made up of at least three driven rollers, where the spatial position of these rollers can be changed by means of drive and positioning facility. On the one hand, each of these rollers in the 3-roller system can be moved in the direction of the roller's axis. This positioning can be effected either for each of them individually or all together. This axial repositioning of the rollers achieves the effect that the center of the metal strip also runs into the roll stand centrally. Since the working rollers of a roll stand generally have a crowned contour or produce a roll gap which is symmetrical relative to the center of the mill, the infeed of the rolling strip must be effected as symmetrically as possible. This is the only way of ensuring the required accuracy in the strip thickness during cold rolling. In particular, a wedge-shaped strip profile tends to run out from the center of the rolling mill. Strip guidance is advantageous here.

On the other hand each of these rollers can be moved, by means of the drive and positioning facility, in a direction transverse to the axis of rotation. This achieves, on the one hand, a significant simplification in the initial feeding-in of the metal strip: by swinging the central roller of the three rollers into a position which is out-of-line relative to the other two rollers, the start of the strip can very easily be fed into the 3-roller system. The feeding-in can also be assisted by a transfer table. A pinch roller, by which the head end of the strip is pressed towards the two supporting rollers, can here form an additional aid in the feeding-in, in particular in the case of very stiff and thick strips. As it advances, the strip then passes into the gap between the working rollers. The feeding-in process is then complete. During the rolling, the working rollers produce a forward tension on the metal strip. By engaging the central roller of the 3-roller system, it is very easily possible to set a desired forward tension at the infeed to the first (cold) rolling stand. For this purpose, the central roller of the 3-roller system presses down into the section of the metal strip which lies between the two supporting rollers. The spatial position of the three rollers defines the wrap-around. The further down the roller is, the greater the wrap-around. By appropriate control of the drives, a desired back tension can be set between the roll stand and the 3-roller arrangement, without this tension having an effect on the forward tension on the metal strip during decoiling, upstream between the decoiler and the 3-roller arrangement, which is comparatively lower. Conversely, fluctuations in the forward tension during the decoiling of a loosely-wound coil do not pass forward to the infeed to the cold-rolling trains. During the rolling process, the 3-roller system acts as a tension decoupler.

In order, particularly in the case of a highly asymmetrical (wedge-shaped) rolling strip profile, to ensure an exact infeed into the cold-rolling stand, in a preferred embodiment provision can be made that simultaneously with the axial positioning of the rollers in the 3-roller system the axial position of the decoiler can also be, or is, positioned as appropriate.

It can be of further advantage if the axis of rotation of the roller on the decoiler side and the axis of rotation of the roller on the cold-rolling stand side lie in one plane, and that the roller located between them can be positioned spatially relative to this plane. The further the central roller is moves down below this plane, the greater is the wrap-around, and consequently the adhesion between the strip and the roller. By this means, the advantageously high forward tension at the infeed to the first cold-rolling stand can be adjusted.

In order to structure the changeover between initial feeding-in and rolling as simply as possible, an embodiment which can be advantageous permits the central roller to be repositioned, by means of a hydraulic actuator, between its out-of-line position in which this roller is isolated from the rolling strip, and its in-line position in which the rolling strip partially wraps around the circumferential surface of this roller.

In order to be able to set a high back tension at the infeed to the roll stand, it is expedient if the central roller is moved down far enough, that is if the wrap-around on the central roller is arranged to be below the plane extending between the axes of rotation of the other two rollers, and if the wrap-around of the two supporting rollers lies above this plane.

It is then possible to set a particularly high forward tension at the infeed region if the central roller is advanced so that the central roller has a wrap-around of more than 180°.

In a particularly preferred embodiment of the invention, provision can be made that the distance between the two supporting rollers which lie in the plane can be changed steplessly by means of the drive and positioning facility. This change can be brought about by moving the two rollers towards or away from each other so that the wrap-around, and consequently the braking effect at the infeed, can be very finely adjusted. However, it can also be advantageous to fix the spatial position of one of the two rollers which lie in the plane, and to change only the position of the other roller relative to this. By this means, fluctuations in the forward tension on the metal strip arising upstream or downstream can be precisely regulated out.

It can be advantageous if the positioning movement of the central roller is a linear movement which encloses an angle which can be prescribed relative to the plane. By this means the wrap-around on the three rollers can be better adapted to correspond to the desired influence on the path of the strip. In addition, the regulation of the roller drives is a simpler technical possibility.

Depending on the size of the mill, it can be of advantage for exercising influence on the path of the strip (strip guidance) if the decoiler can be repositioned, together with or separately from the rollers of the 3-roller system, in the direction of the axes of rotation of the rollers, by means of a common or a separate drive and positioning facility. For large mills, separate construction can be advantageous, for small mills a common drive and positioning facility.

It is expedient to detect the side position of the strip at the infeed to the first roll stand by metrological means. This can be done, for example, by means of a sensor which detects the position of an edge, or both edges, of the strip, and feeds the measured signal to the drive and positioning facility. From the measurement signal for the strip position, the drive and positioning facility determines a control signal for setting the axial position of the 3-roller system, and if necessary also that of the decoiler.

BRIEF DESCRIPTION OF THE DRAWINGS

For the purpose of explaining the invention further, the following part of the description refers to the drawings, from which are to be inferred, by reference to an exemplary embodiment which is not to be taken as restrictive, further advantageous embodiments, details and developments of the invention.

In the drawings.

EMBODIMENT OF THE INVENTION

Figure 1:
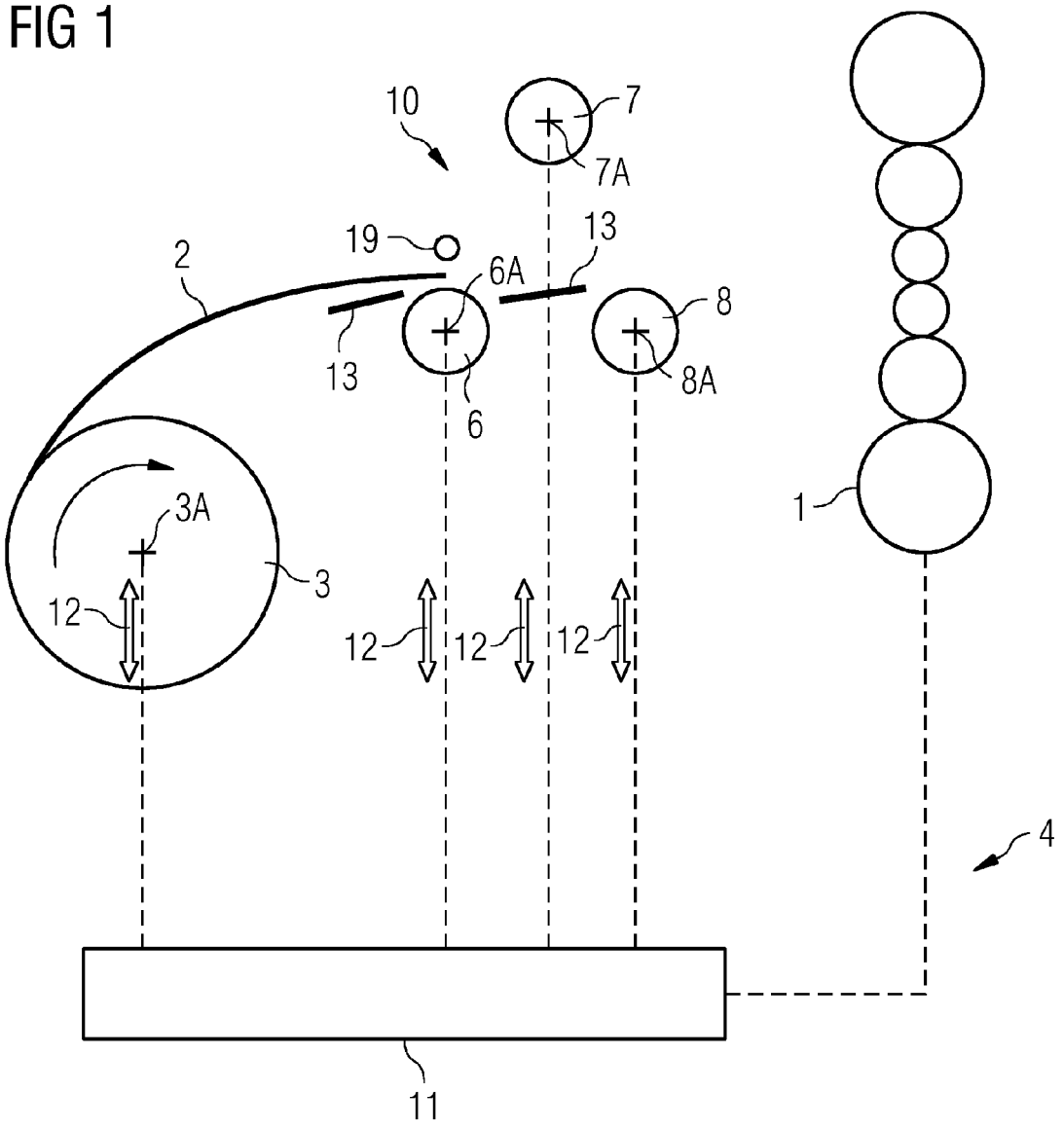
FIG. 1 shows a schematic side view of the inventive rolling mill in an initial feeding-in state, in which the central roller is disengaged.

FIG. 1 shows a schematic side view of the inventive rolling mill in a position in which the start of the strip is fed into the roll stand 1. A steel strip 2 which is rolled up into a coil is unwound in a clockwise direction by a decoiler 3 and passes from left to right towards the unit 10. This unit 10 comprises three rollers 6, 7, 8, of which the central roller 7 is pivoted away from the path of the strip and is not engaged with the metal strip 2 (feed-in setting). The metal strip 2 is initially transported on a part of a transfer table 13 and is thereafter supported by the roller 6, by a second part of the transfer table 13 and the roller 8. In the case of very stiff metal strips, this process of feeding-in may, if necessary, also be assisted by a pinch roller 19. The transfer table 13 can be pivoted into and out of the path of the strip by drives, not shown in the drawing.

As indicated in FIG. 1 by the arrows 12, the spatial position of the rollers 6, 7, 8, and if necessary also the decoiler 3, can be changed by means of a drive and positioning facility 11. In other words, each of the rollers 6, 7, 8 can not only be driven rotationally about its associated axis of rotation and positioned in the axial direction (together with each other or separately) 6A, 7A, 8A by the drive and positioning facility 11, but it is also possible to adjust the location of any of the rollers 6, 7, 8 in a direction transverse to its axis of rotation 6A, 7A, 8A by means of the drive and positioning facility 11.

Particularly in the case when the rolling strip has a wedge-shaped cross section it is expedient if the decoiler 3 is positioned in the direction of its axis of rotation 3A at the same time as the 3-roller system is axially positioned. By this means, the metal strip 2 can be guided into the center of the cold-rolling stand 1.

It should be noted at this point that drive and positioning facilities 11, with which it is possible to prescribe or adjust a rotational movement and at the same time also the spatial position of a roller (or if necessary also a decoiler) for a rolling mill, can be actuated hydraulically or electro-mechanically.

In what follows, such facilities are assumed to be familiar, and thus do not need to be explained in more detail here.

Figure 2:
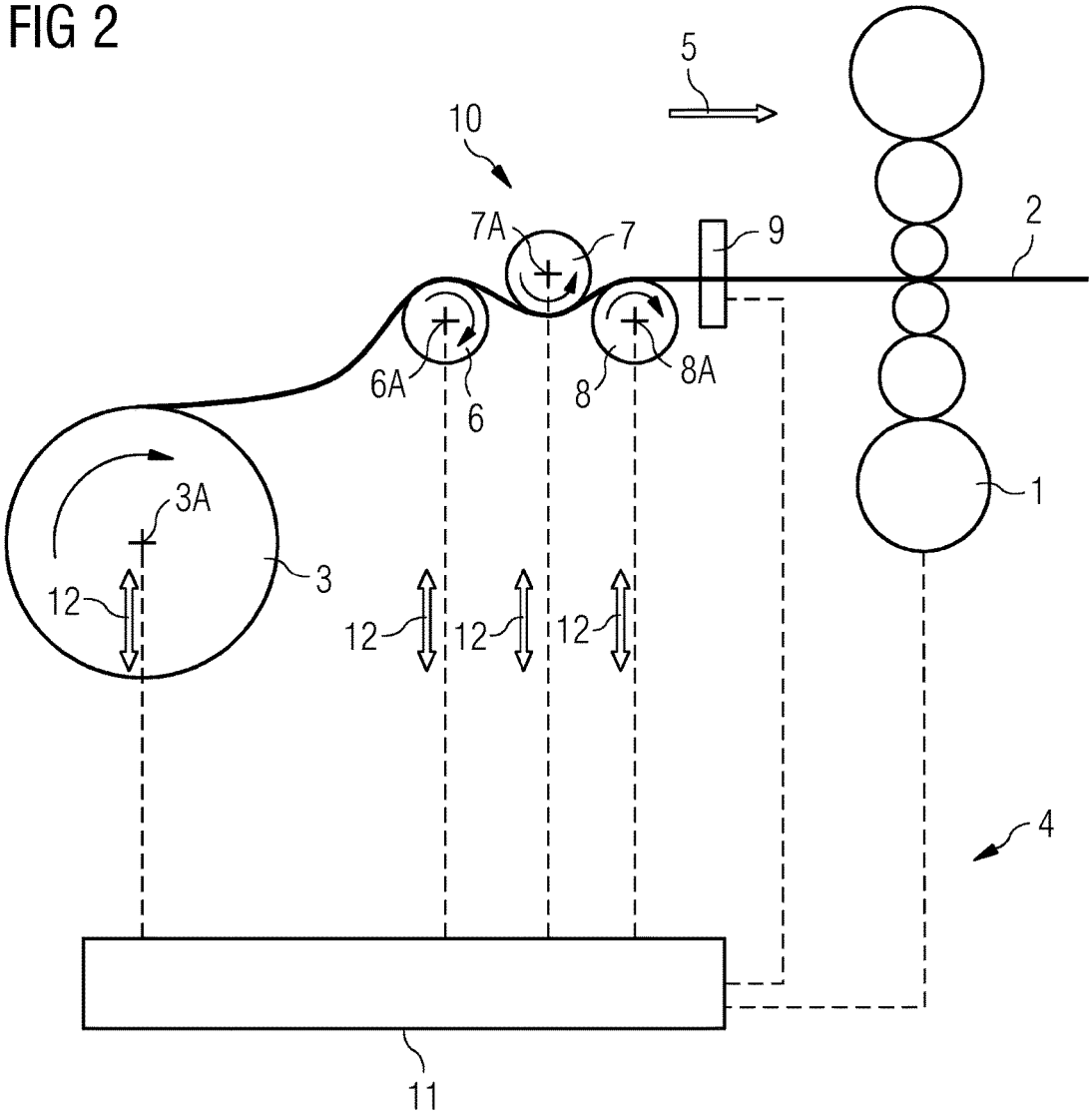
FIG. 2 shows the cold-rolling mill shown in FIG. 1, in the rolling state, in which the central roller is engaged with the metal strip.

FIG. 2 shows the state during cold rolling. After the rolling strip 2 has been initially fed into the gap between the working rollers of the rolling mill 1, and has been gripped by it, a forward tension is exerted on the metal strip 2. As already described in the introduction, it should be possible to prescribe the forward tension and the path of the strip at the region of the infeed to the roll as far as possible independently of the forward tension in the region of the decoiler 3. Fluctuations in the forward tension during decoiling of the coil should as far as possible not reach the region of the infeed to the roll stand 1. As shown in FIG. 2, the unit 10 is provided for this tension decoupling. In this illustration, the central roller 7 of the unit 10 is pivoted to be in-line. The metal strip 2 wraps around part of the area of the outer surface of each of the three rollers 6, 7, 8. As already stated, each roller 6, 7, 8 is driven rotationally by a drive which is not shown in more detail. The drive torque for the rollers 6, 7, 8 is then prescribed by the drive and positioning facility 11 such that, on the one hand, a braking effect is exerted on the metal strip 2. This braking effect enables a desired minimum magnitude of tension to be correctly maintained at the infeed to the cold-rolling stand 1. This back tension is largely independent of and unaffected by fluctuations in the tension which can arise when a loosely wound coil is unwound. Further, the drive and positioning facility 11 also influences the spatial position of the axes of rotation of the rollers 6, 7, 8 (if necessary also that of the decoiler 3 in the direction of its axis of rotation 3A). By a displacement in the axial direction of the rollers, it is possible to exercise an influence over not only the forward tension but also over the path of the strip. This exercise of influence (on both the rotational movement and also on the axial positions of the axes of rotation) is indicated symbolically in FIG. 2 by dashed lines (operating and signaling link 4) and by the arrows 12. For the sake of clarity, the drives and actuators for these positioning operations are not shown in more detail in the drawings.

For the purpose of detecting the position of the strip, a strip position detector 9 is used, this being arranged between the unit 10 and the cold-rolling stand 1. Monitoring of the strip path can be effected, for example, by detecting metrologically the edge(s) of the metal strip. This strip position detector 9 is linked by a signaling link to the drive and positioning facility 11. Using the measurement signal which is fed to it, a conventional regulator is well able to counteract any errors in the path of the metal strip 2. This is particularly advantageous in cases where the metal strip has a cross sectional profile which is wedge-shaped.

Figure 3:
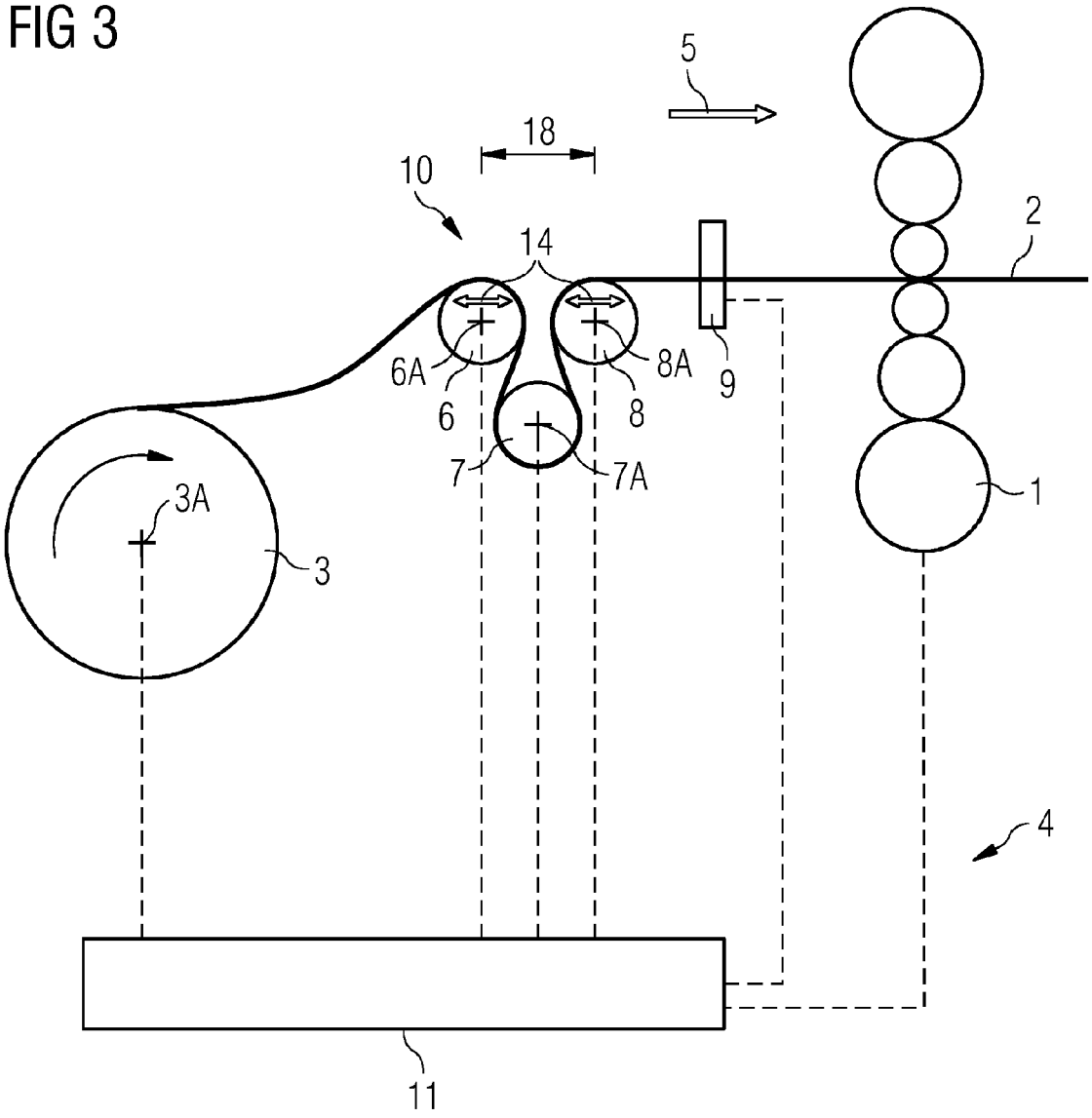
FIG. 3 shows the cold-rolling mill shown in FIG. 1, where the central roller is moved down below the direct passage line, and fluctuations in tension are regulated out by a positioning movement, in the direction of the path of the strip, of the roller on the input side and/or on the output side.

FIG. 3 also shows the state during the rolling operation. A difference from the illustration in FIG. 2 is that the central roller 7 has been moved down far below the two rollers 6, 8. As a result, the wrap-around on roller 7 extends over a large angle, with a comparatively larger wrap-around angle also on the rollers 6, 8. This angle of wrap-around can be adjusted by prescribing the position of roller 6 or the position of roller 8, as applicable, as shown in each case by the arrow 14. In doing so, the axis of rotation of one of the rollers 6, 8 can be moved, or even both of them. If the distance 18 between the axes of rotation 6A, 8A is changed in this way, then the wrap-around will also change.

Figure 4:
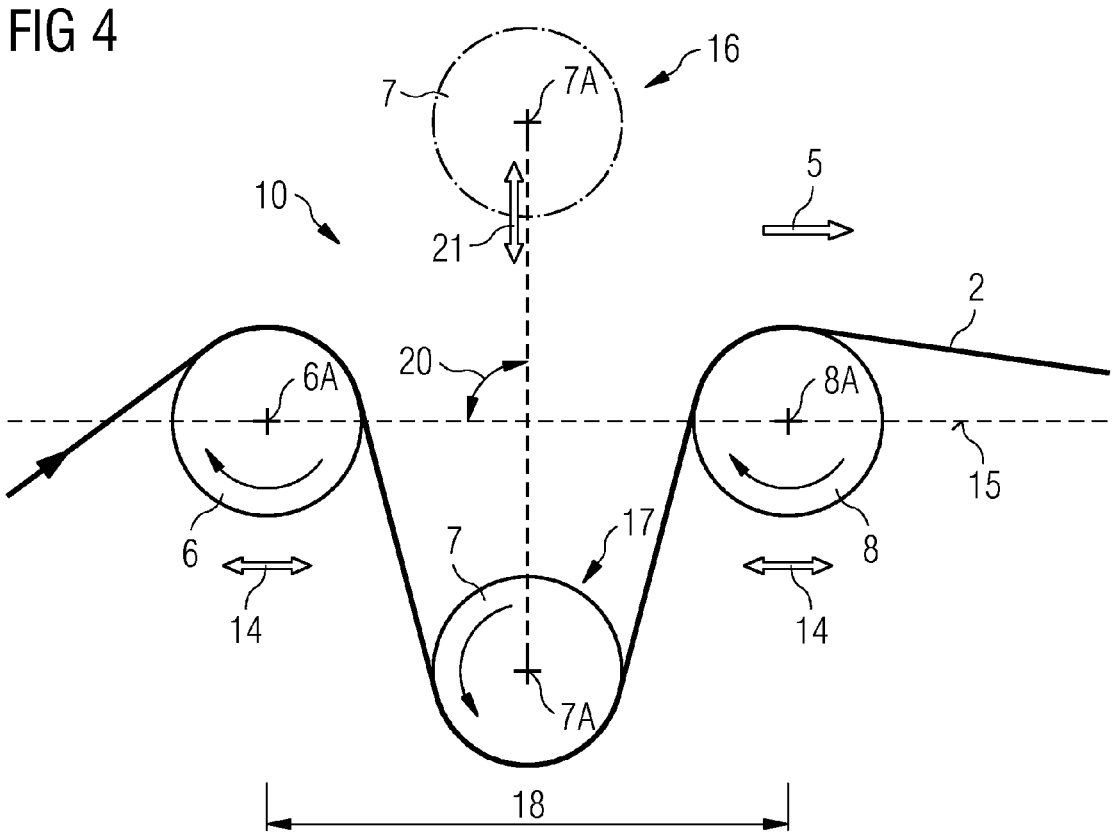
FIG. 4 shows a detailed view of the 3-roller system.

As illustrated in the diagram in FIG. 4, of a detail of the 3-roller system, the central roller 7 can be positioned, for example by a hydraulic actuator which is not shown in more detail, between an out-of-line position 16 and an in-line position 17. This positioning movement 21 can be effected perpendicularly to or at an angle 20 with respect to the plane 15. A change in the angle 20 of the engagement movement 21 influences the wrap-around on the rollers 6, 7, 8.

The axes of rotation 6A, 7A, 8A of the rollers 6, 7, 8 are parallel relative to each other and to the plane 15. With the roller 7 in the position shown in FIG. 4, its wrap-around region is beneath the plane 15 which extends through the axes of rotation 6A, 8A of the rollers 6, 8. The axes of rotation 6A and 8A of the outer rollers 6 and 8 can be moved in the plane 15 (roughly in the direction of the strip path 5) in the direction of the double-ended arrow 14. If the downwards movement of the roller 7 is sufficiently large, the distance 18 between the two rollers 6, 8 can be chosen to be very small, so that the 3-roller system permits the establishment of a high tension to be realized. This is of advantage, in particular, in the cold-rolling of thin and hard metal strips. By prescribing the angle 20 of the engagement movement relative to the plane 15, the wrap-around can be arranged to be different on the rollers 6, 7, 8.

In principle it is also possible that, in the case of a tightly wound coil, the engageable central roller 7 remains positioned aside even during the rolling.

With the 3-roller system illustrated above, it is possible in a simple way to achieve tensional decoupling at the same time as establishing a desired tension in the infeed region and good strip guidance for metal strips. Using the downwards movement of the central roller 7 in conjunction with the ability to effect horizontal positioning of the two outer rollers 6, 8 of the 3-roller system, it is advantageously possible to adjust the tension produced, and hence to ensure a high back tension in the roll stand 1 which follows. In conjunction with the transfer table 13 illustrated above, and if necessary with the assistance of a pinch roller 19, the initial feeding-in operation is comparatively simple, even for stiff metal strips 2.

The possibility of a simultaneous axial positioning of the decoiler 3 and of the 3-roller unit, which may be rigidly coupled to it or may be separately movable, permits very good regulation of the strip path. The advantage of effective strip path regulation comes to the fore particularly in the case of metal strips which have an uneven cross-sectional profile.

Although the invention has been illustrated and described in detail above by reference to a preferred form of embodiment of a cold-rolling mill, the invention is not restricted by this disclosed example. The invention can equally well be used with other rolling mills, e.g. with hot rolling. Over and above this, the person skilled in the art can derive other variations therefrom, without departing from the scope of protection for the invention.

LIST OF REFERENCE CHARACTERS USED

1 Roll stand, cold-rolling stand
2 Strip

3 Decoiler
4 Link (operating and signaling link)
5 Direction of strip path
6 Roller
7 Roller
8 Roller
9 Strip position detector
10 Unit, 3-roller system
11 Drive and positioning facility
12 Arrow (direction of positioning of rollers 6, 7, 8, vertical)
13 Transfer table
14 Arrow (direction of positioning of rollers 6, 8, horizontal)
15 Plane
16 Out-of-line position of roller 7
17 In-line position of roller 7
18 Distance
19 Pinch roller
20 Angle
21 Arrow, direction of engagement movement for roller 7
3A Axis of rotation of the decoiler 3
6A Axis of rotation of the roller 6
7A Axis of rotation of the roller 7
8A Axis of rotation of the roller 8

The invention claimed is:

1. A cold-rolling mill for cold-rolling of a metal strip, the mill comprising: at least one cold-rolling stand, a decoiler positioned upstream of the cold-rolling stand, and a unit in-line between the decoiler and the cold-rolling stand, the unit is comprised of at least three rollers, each of said at least three rollers of said unit is rotationally driven about a respective axis of rotation; and a drive and positioning facility that controls the driven rotation and the spatial positioning of said at least three rollers of said unit and the decoiler, said drive and positioning facility configured for repositioning, during cold rolling of the metal strip, each of said at least three rollers of said unit in the direction along each of said respective axis of rotation of each of said at least three rollers of said unit and in a direction transverse to said each respective axis of rotation, wherein each of said at least three rollers of said unit is configured to be repositioned with the drive and positioning facility in the direction along said each respective axis of rotation and in the direction transverse to said each respective axis of rotation.

2. The rolling mill as claimed in claim 1, wherein the axis of rotation of a first one of the rollers which is located closer to the decoiler and the axis of rotation of a third one of the rollers which is located closer to the cold-rolling stand lie in a first plane and a second one of the rollers is a central roller arranged between the first and third rollers, wherein the central roller is repositionable to be spatially positioned relative to the first plane, and the central roller is so positioned by the drive and positioning facility.

3. The rolling mill as claimed in claim 2, wherein the central roller is repositionable between an out-of-line position, in which the central roller is not engaged with the rolling strip, and an in-line position, in which a circumferential surface of the central roller is partially wrapped around by the rolling strip.

4. The rolling mill as claimed in claim 3, wherein in the in-line position of the central roller, a wrap-around of the strip on the central roller is arranged beneath the first plane, and a wrap-around of the strip on the first and third rollers is arranged above the first plane.

5. The rolling mill as claimed in claim 4, wherein in the in-line position of the central roller, the wrap-around of the strip on the central roller is greater than 180°.

6. The rolling mill as claimed in claim 5, wherein a distance between the respective axes of rotation of the first and third rollers in the first plane can be adjusted, and the drive and positioning facility is configured and operable for adjusting the distance between the axes of the first and third rollers.

7. The rolling mill as claimed in claims 1, wherein when the central roller is being repositioned, the direction of movement of the central roller is at an angle to a first plane.

8. The rolling mill as claimed in claim 1, wherein the drive and positioning facility is operable to reposition the decoiler, together with or separately from the rollers, in the direction of the axes of rotation of the rollers.

9. The rolling mill as claimed in claim 1, further comprising a measurement device configured for detecting the position of the strip and arranged between the unit and the cold-rolling stand; and the measurement device has a signaling link with the drive and positioning facility.

10. A method of cold-rolling of a metal strip with a rolling mill, the mill comprising at least one cold-rolling stand through which the metal strip is advanced, a decoiler positioned upstream of the cold-rolling stand, a unit configured for influencing the path of the cold-rolled strip is located in-line between the decoiler and the cold-rolling stand, and is comprised of three rollers each driven about a respective axis of rotation, and a drive and positioning facility that controls the driven rotation and the spatial positioning of said three rollers of said unit and the decoiler, the method comprising: selectively repositioning each of said three rollers of said unit during the cold-rolling operation, by means of said drive and positioning facility, both in a direction along each said respective axis of rotation of each of said three rollers of said unit and in a direction transverse to each said respective axis of rotation of each of said three rollers of said unit.

11. The method as claimed in claim 10, further comprising selectively repositioning the axis of rotation of a first one of the rollers located closest to the decoiler and the axis of rotation of a third one of the rollers located closest to the cold-rolling stand to lie in a plane and selectively repositioning the central roller that is between the first and the third rollers in the direction of advance of the strip path to be positioned relative to the plane.

12. The method as claimed in claim 10, further comprising repositioning the central roller between an out-of-line position, in which the central roller is not engaged with the rolling strip, and an in-line position, in which the rolling strip is partially wrapped around a circumferential surface of the central roller.

13. The method as claimed in claim 12, wherein by repositioning the central roller in the in-line position thereof, a wrap-around of the strip on the central roller is arranged beneath the plane, and wrap-around of the strip on the first and third rollers lies above the plane.

14. The method as claimed in claim 13, wherein in the in-line position of the central roller the rolling strip wraps around the central roller over an angle greater than 180°.

15. The method as claimed in claim 14, further comprising adjusting the distance between the axes of rotation of the first and third rollers in the plane is by means of a drive and positioning facility.

16. The method as claimed in claim 15, further comprising adjusting a direction of movement of the central roller when the central roller is being engaged is effected at an angle to the plane.

17. The method as claimed in claim 16, further comprising: adjusting the decoiler together with or separately from the rollers, in the direction of the axes of rotation of the rollers by means of a drive and positioning facility.

18. The method as claimed in claim 17, further comprising detecting a position of the strip between the unit and the cold-rolling stand, and submitting a measurement signal for the position of the strip to be transmitted over a signaling link to a drive and positioning facility for the decoiler and the rollers.

19. The method as claimed in claim 10, further comprising initially feeding the metal strip using a two-part transfer table for the strip, by arranging a first part of the table which is upstream from the rollers to be located beside the decoiler and by arranging a second part of the table between a first one of the rollers and a third one of the rollers in a direction of advancing of the strip.

20. The method as claimed in claim 19 further comprising positioning the transfer table in-line; and during an initial feeding-in of the strip, moving a pinch roller towards the transfer table which has been positioned in-line.

21. The method as claimed in claim 10, wherein the rollers and the decoiler are positioned by means of a drive and positioning facility.

22. A cold-rolling mill for cold-rolling of a metal strip, the mill comprising:

at least one cold-rolling stand, a decoiler positioned upstream of the cold-rolling stand, and a unit positioned in-line between the decoiler and the cold-rolling stand, the unit is comprised of at least three rollers, each of said at least three rollers of said unit is rotationally driven about a respective axis of rotation, wherein each of said at least three rollers of said unit is configured to be repositioned individually in a direction transverse to said each respective axis of rotation of said at least three rollers of said unit; and a drive and positioning facility that controls the driven rotation and the spatial positioning of said three rollers of said unit and the decoiler, said drive and positioning facility configured for repositioning, during cold rolling, said each of at least three rollers of said unit in the direction transverse to said each respective axes of rotation of said at least three rollers of said unit.

23. A cold-rolling mill for cold-rolling of a metal strip, the mill comprising:

at least one cold-rolling stand, a decoiler positioned upstream of the cold-rolling stand, and a unit positioned in-line between the decoiler and the at least one cold-rolling stand, the unit comprising at least three rollers, each roller of said at least three rollers of said unit is rotationally driven about a respective axis of rotation, wherein each of said at least three rollers of said unit is configured to be repositioned in a direction along each of said respective axis of rotation of said at least three rollers of said unit; and a drive and positioning facility that controls the driven rotation and spatial positioning of said three rollers of said unit and the decoiler, said drive and positioning facility configured for repositioning, during cold rolling, said at least three rollers of said unit in the direction along each of said respective axes of rotation of said at least three rollers of said unit.

24. A method of cold-rolling of a metal strip with a rolling mill, the mill comprising at least one cold-rolling stand through which the metal strip is advanced, a decoiler positioned upstream of the cold-rolling stand, a unit configured for influencing a strip path located in-line between the decoiler and the cold-rolling stand, the unit comprising one or more rollers, each of said one or more rollers of said unit being driven about a respective axis of rotation, and a drive and positioning facility that provides the drive and relative positioning of said one or more rollers of said unit, the method comprising: selectively repositioning each roller of said one or more rollers of the unit during the rolling operation, by means of a drive and positioning facility, in a direction along the respective axis of rotation of each roller of the one or more rollers of said unit to influence the strip path in a cold-rolling operation.

* * * * *